US006165066A

United States Patent [19]

Sharp et al.

[11] Patent Number: 6,165,066

[45] **Date of Patent: *Dec. 26, 2000**

[54] MULTI-PART FOUNDATION VENTILATOR OF VARIABLE PRESELECTED WIDTH

[75] Inventors: Tom Sharp, San Ramon; W. Brent Taylor, Manhattan Beach, both of Calif.; Greg Ernst, Boring, Oreg.; David J. Manger, Graham; Mark Shaff, Ridgefield, both of Wash.

[73] Assignee: Kaibab Metals, Inc., Baldwin Park, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/273,116

[22] Filed: Mar. 19, 1999

Related U.S. Application Data

[60] Provisional application No. 60/078,876, Mar. 20, 1998, and provisional application No. 60/079,929, Mar. 30, 1998.

[51] Int. Cl.[7] ..... F24F 7/00

[52] U.S. Cl. ..... 454/273; 52/302.1; 454/271

[58] Field of Search ..... 454/270, 271, 454/272, 273, 274; D23/381, 393; 52/302.1, 656.2, 656.8, 745.09, 745.15, 745.16, 220.8; 249/37, 38, 39; 264/35

[56] References Cited

U.S. PATENT DOCUMENTS

| | | | |
|---|---|---|---|
| D. 258,985 | 4/1981 | Peirce et al. | D23/163 |
| D. 259,736 | 6/1981 | Peirce et al. | D23/163 |
| D. 260,117 | 8/1981 | Peirce et al. | D23/163 |
| D. 269,293 | 6/1983 | Peirce et al. | D23/151 |
| D. 269,700 | 7/1983 | Peirce et al. | D23/151 |
| 1,673,379 | 6/1928 | Swift . | |
| 2,565,122 | 8/1951 | Cowan . | |
| 2,843,035 | 7/1958 | Jacks . | |
| 4,026,082 | 5/1977 | Crofoot | 52/302 |
| 4,469,018 | 9/1984 | Taulman . | |
| 4,669,371 | 6/1987 | Sarazen, Jr. et al. . | |
| 5,444,947 | 8/1995 | Miller | 52/100 |
| 5,460,572 | 10/1995 | Waltz et al. | 454/273 |
| 5,496,213 | 3/1996 | Miller | 454/271 |

FOREIGN PATENT DOCUMENTS

| | | |
|---|---|---|
| 278221 | 10/1955 | Switzerland . |
| 2541 | 12/1890 | United Kingdom . |
| 8210 | 3/1898 | United Kingdom . |

*Primary Examiner*—Harold Joyce
*Attorney, Agent, or Firm*—R. Reams Goodloe, Jr.

[57] ABSTRACT

A multi-part foundation ventilator. The ventilator has a first frame member with a first exterior peripheral edge flange, and, extending inwardly therefrom, a protruding wall portion of preselected width $X_{1(A)}$. The first inwardly protruding wall portion has an outer surface portion with a first receiving ledge portion and a protruding, first joining flange portion. A second frame member has a second inwardly protruding wall portion of preselected width $X_{2(A)}$. The second inwardly protruding wall portion further includes an outer surface portion, with a second receiving ledge portion and a second joining flange portion. The first joining flange portion of the first frame member is sized and shaped to fit in close fitting, overlying engagement with the second receiving ledge portion of the second frame member. The second joining flange portion of the second frame member is sized and shaped to fit in close fitting, overlying engagement with the first receiving ledge of the first frame member, so that the first frame member and the second frame member are securely joined in mating engagement at a sealed, substantially leafless joint therebetween.

57 Claims, 11 Drawing Sheets

MULTI-PART FOUNDATION VENTILATOR OF VARIABLE PRESELECTED WIDTH

This application claims benefit of Provisional Appl. 60/078,876, filed Mar. 20, 1998 and Provisional Appl. 60/079,929 filed Mar. 30, 1998.

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

Our invention relates to foundation ventilators, typically used in foundations in residential and light commercial construction, and more particularly, to ventilators which can be easily manufactured in a desired width for use in a foundation wall of preselected thickness.

BACKGROUND

In residential and light commercial construction, it is common practice to provide, either in a poured concrete foundation wall or in a constructed block foundation wall, a ventilator opening to allow air circulation beneath the building structure. Many workable ventilators have been developed thru the years for such applications.

However, it would still be quite desirable to reduce the overall costs which must necessarily be incurred in the manufacture and distribution of such ventilators. Also, labor saving techniques, or changes in the apparatus which would reduce the cost of installation, would be welcome by the contractors charged with installing such ventilators.

We are aware of various attempts in which an effort has been made to provide an improved foundation ventilator. One of the designs which resembles the instant invention to some remote extent is disclosed by Crofoot, in U.S. Pat. No. 3,822,462, issued May 31, 1977, for VENT FRAMES. He shows a foundation ventilator which is fastened together from two identical hollow frame sections. However, he does not provide a design which includes the feature of interlocking flanges for "one-way" mating engagement of frame sections, nor does his method of fastening provide an overhanging lip joined to an underlying ledge to effectively prevent concrete slurry from entering the interior of the vent through the assembly joint, as is provided in our novel foundation ventilator. Thus, the advantages of our simple multi-part foundation ventilator, which is made with interlocking frame members that are designed for assembly in a pre-selected width, to provide a strong, substantially leak resistant through-wall ventilator, are important and self evident.

OBJECTS, ADVANTAGES, AND NOVEL FEATURES

It is the object of our invention to provide a novel foundation ventilator that is easily assembled in "one-way" mating engagement from first and second frame members, each having overlapping flanges that provide resistance against concrete slurry entering the vent during construction of walls. Our foundation ventilator has a first frame member having a first exterior peripheral edge flange, and, extending inwardly therefrom a protruding wall portion of preselected length $X_{1(A)}$. The first inwardly protruding wall portion has an inner surface portion defining a first thru passageway portion. A second frame member is provided that has a second exterior peripheral edge flange, with a second inwardly protruding wall portion of preselected length $X_{2(A)}$. The second inwardly protruding wall portion has an inner surface portion defining a second thru passageway portion. Thus, the first and second frame members are each designed with flange portions that fit in close fitting, overlying engagement each with the other, so that the first frame member and said second frame member securely joined in mating engagement with an essentially leakless joint therebetween.

From the foregoing, it will be apparent to the reader that one very key, important and primary object of the present invention resides in the provision of a novel, multi-part foundation ventilator which simplifies the manufacture of ventilators of various widths. This is done by providing a first frame member and a second frame member, each of which can be selected in a desired width and with interlocking docking ledges and flanges for precisely and securely interfitting the mating surfaces of each of the first and second frame members, so that they are easily joined into a finished, sealed, substantially leakless foundation ventilator.

Other important but more specific objects of the invention reside in the provision of a multi-part foundation ventilator as described herein which:

- Can be manufactured in preselected widths by joining a chosen first and a chosen second frame member, each of which has been provided in an appropriate preselected size so that their combined width, when joined into a finished foundation ventilator, is of the desired preselected overall width; can be manufactured in a simple, straightforward manner to provide a sturdy, strong, foundation ventilator;
- provide a design which allows assembly from first and second frame member parts, each of which have a strong central vertical column and horizontal beam support members, so that the final, finished foundation ventilator is sturdy, with two high strength central vertical columns and double horizontal beam support members;
- which in a relatively inexpensive manner can reduce inventory costs at the manufacturing level, and can increase the flexibility of the manufacture to provide a distributor with foundation ventilators of various widths;
- can be manufactured in a grey plastic to unobtrusively match concrete;
- can be manufactured with impact-resistant ABS plastic;
- can be provided ready to install, with preset nails included as an integral part of the complete foundation ventilator package;
- can be finished with a substantially liquid tight sealed joint between the first frame member and the second frame member, and thus is sealed to resist leakage of concrete slurry through the joint therebetween;
- is available with releasably attachable doors, so that the foundation ventilator can be used with or without doors;
- has a manually grippable and manipulable finger-bar latch on the doors, for easy opening and closing;
- is provided with a novel friction latch mechanism on the doors, for releasable frictional positioning of the doors at a desired degree of opening;

Other important objects, novel features, and additional advantages of our invention will become apparent to the reader from the foregoing and from the appended claims and as the ensuing detailed description and discussion proceeds in conjunction with the accompanying drawing.

SUMMARY OF THE INVENTION

We have now invented and disclose herein a novel multi-part foundation ventilator. The foundation ventilator has a first frame member having a first exterior peripheral edge flange, and, extending inwardly therefrom a protruding wall portion of preselected length $X_{1(A)}$. The first inwardly protruding wall portion has an inner surface portion defining a first thru passageway portion. The first inwardly protruding wall portion further includes an outer surface portion having a distal edge, and at least a portion of the outer surface portion adjacent to the distal edge further has a first receiving ledge portion. Also, at least a portion of the first inwardly protruding wall portion further includes, adjacent to the distal edge of the outer surface portion, a protruding, first joining flange portion.

A second frame member is provided that has a second exterior peripheral edge flange, with a second inwardly protruding wall portion of preselected length $X_{2(A)}$. The second inwardly protruding wall portion also has an inner surface portion which defines a second thru passageway portion. Also, the second inwardly protruding wall portion further includes an outer surface portion having a distal edge, and at least a portion of the outer surface portion adjacent to the distal edge has a receiving ledge portion. At least a portion of the second inwardly protruding wall portion further includes, adjacent to the distal edge of the outer surface portion, a protruding, second joining flange portion. The first joining flange portion of the first frame member is sized and shaped to fit in close fitting, overlying engagement with the second receiving ledge portion of the second frame member. The second joining flange portion of the second frame member is sized and shaped to fit in close fitting, overlying engagement with the first receiving ledge of the first frame member, so that the first frame member and the second frame member are securely joined in mating engagement at a sealed, substantially leakless joint therebetween.

Our novel multi-part ventilator provides a simple, foolproof design for assembly of foundation ventilators of various widths. This design provides a significant improvement in the art by reducing complexity of manufacture of ventilators of various widths, and thus reducing inventory costs for carrying the necessary parts to provide various width ventilators.

DESCRIPTION

Figure 1:
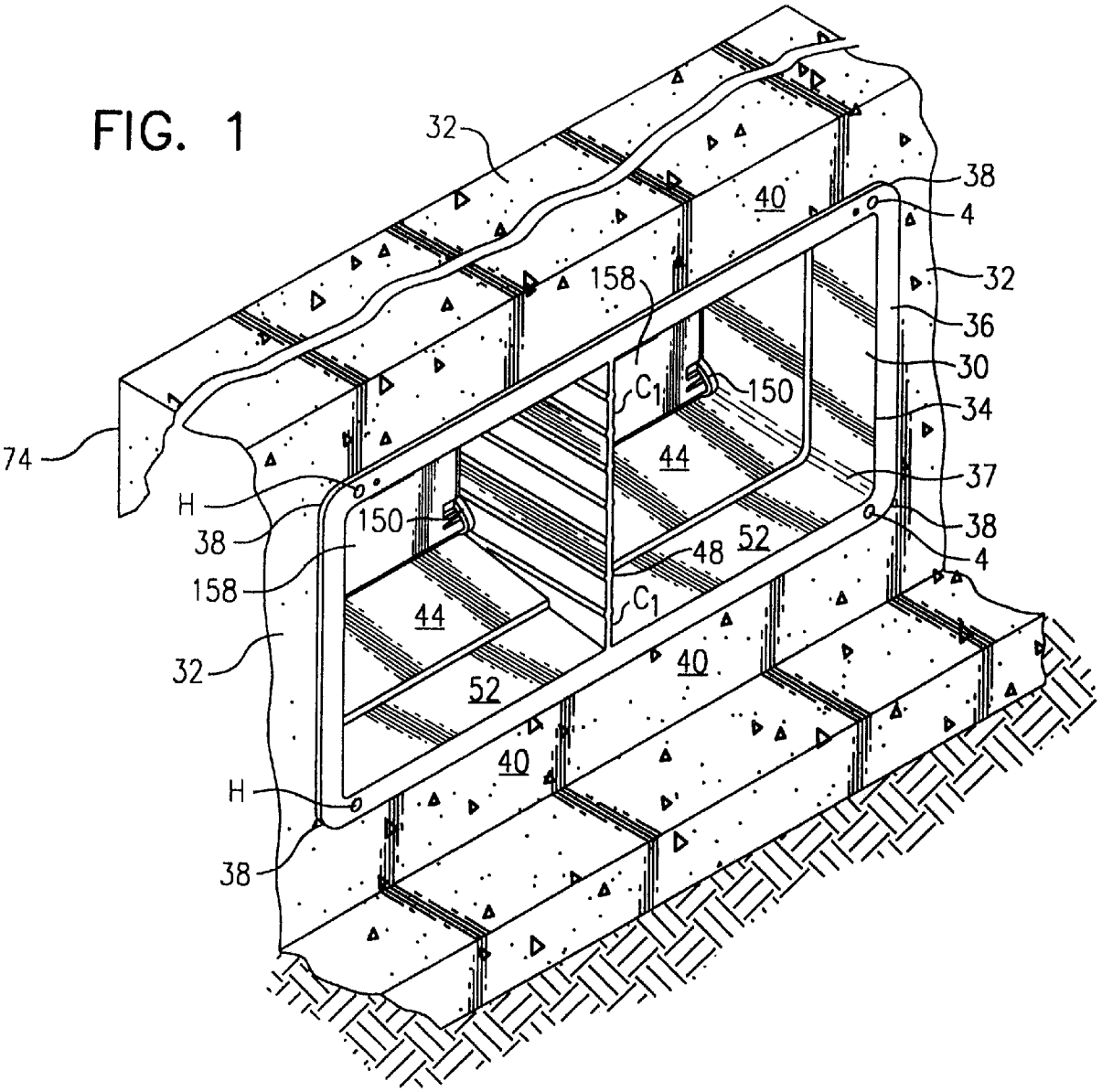
FIG. 1 is a perspective view of our multi-part ventilator, shown installed in a concrete foundation wall.
Figure 2:
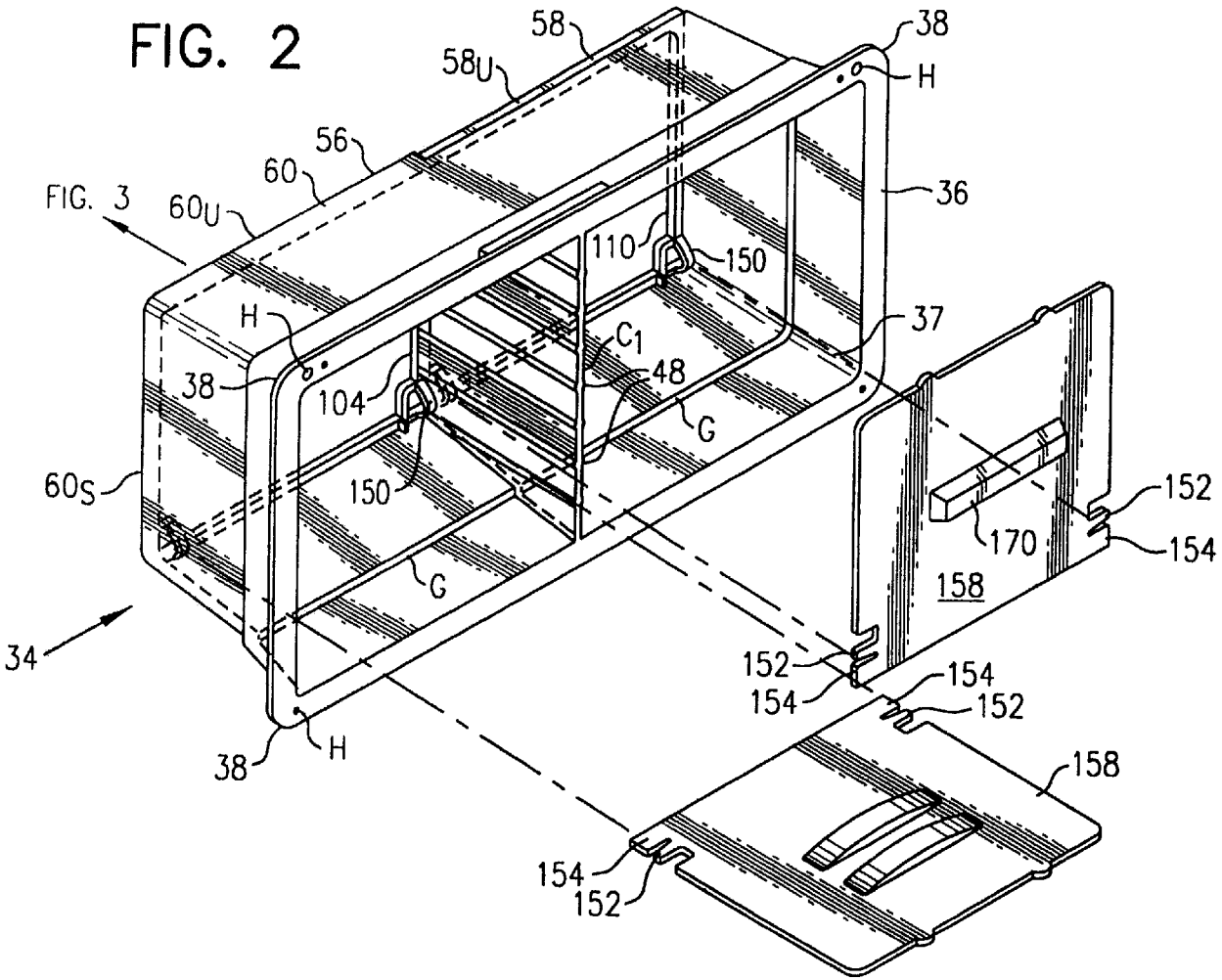
FIG. 2 is a perspective view of a first frame member of our multi-part foundation ventilator design, showing how the doors are detachably affixed to the hinges, and also showing two different door handle designs.

Attention is directed to FIG. 1 of the drawing, where a foundation ventilator 30 is shown as placed in a finished concrete type foundation wall 32. Foundation ventilator 30 is of multi-part construction, and as more fully revealed in FIG. 4, it is most advantageously and simply formed by joining a first frame member 34 with a second frame member 35. The first frame member 34 preferably has a exterior peripheral edge flange 36. The exterior peripheral edge flange 36 extends around the exterior of the first frame member 34 at the outer extremity thereof. The peripheral edge flange 36 is also preferably integrally molded with the first frame member 34 in a width $W_{36}$, normally of narrow thickness $T_{36}$, rather than simply being affixed to frame member 34. Ideally, a radiused interior corner joint RC is utilized to join the peripheral edge flange 36 to first frame member 34. A similar radiused interior corner joint RC is utilized to join second frame member 35 to its peripheral edge flange 70, as better seen in FIG. 4, for example. For most applications, the ventilator 30 is preferably shaped, when viewed from the side, as a parallelogram, or more preferably, as a rectangle with slightly rounded interior corners 37. In such cases, the exterior peripheral edge flange 36 has a corresponding rectangular shape with slightly rounded exterior corners 38. The exterior peripheral edge flange 36 has a rear surface 39 that fits flush within the outer surface 40 of wall 32.

Figure 4:
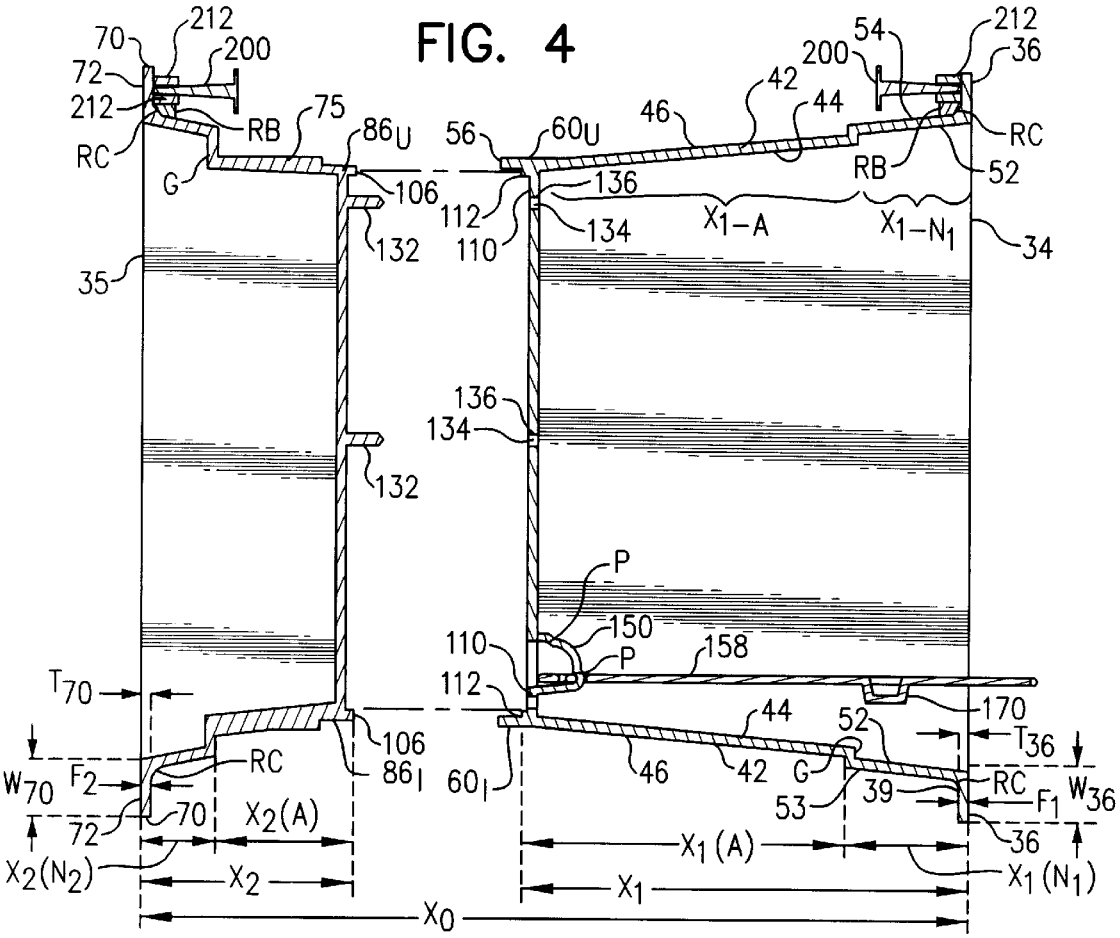
FIG. 4 is a vertical cross-sectional view of our multi-part foundation ventilator, showing how the first frame member as shown in FIG. 2 above is jointed with the second frame member as illustrated in FIG. 3 above.
Figure 21:
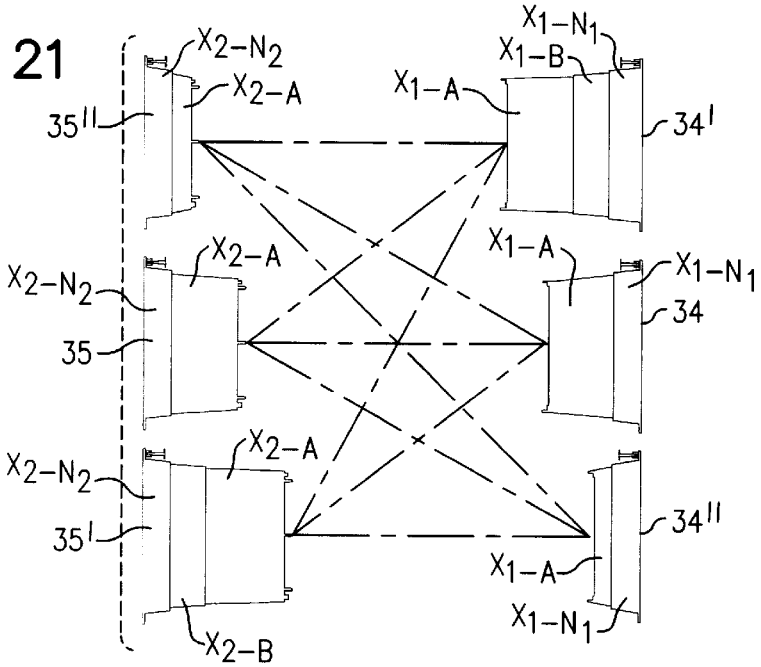
FIG. 21 is a graphical representation of the method of assembly of a foundation ventilator of pre-selected size, by affixing a first frame portion to a second frame portion, where each of the first and second frame portions are selected in a width to produce an assembled foundation ventilator of desired thru-wall thickness.
Figure 5:
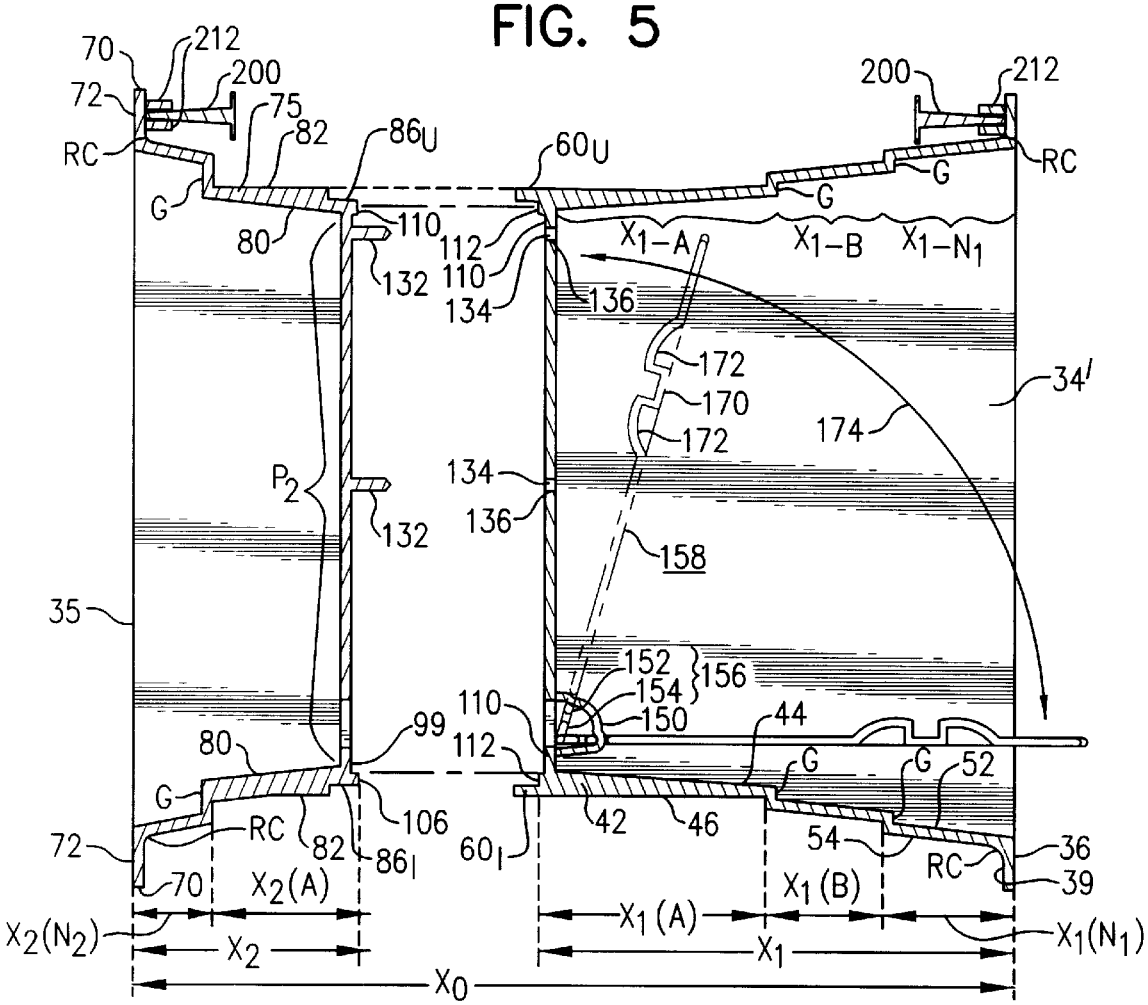
FIG. 5 is a vertical cross-sectional view of another embodiment of our multi-part foundation ventilator, showing a first frame member having three interior ledges, and a second frame member of the design set forth in solid lines in FIG. 3 above.
Figure 8:
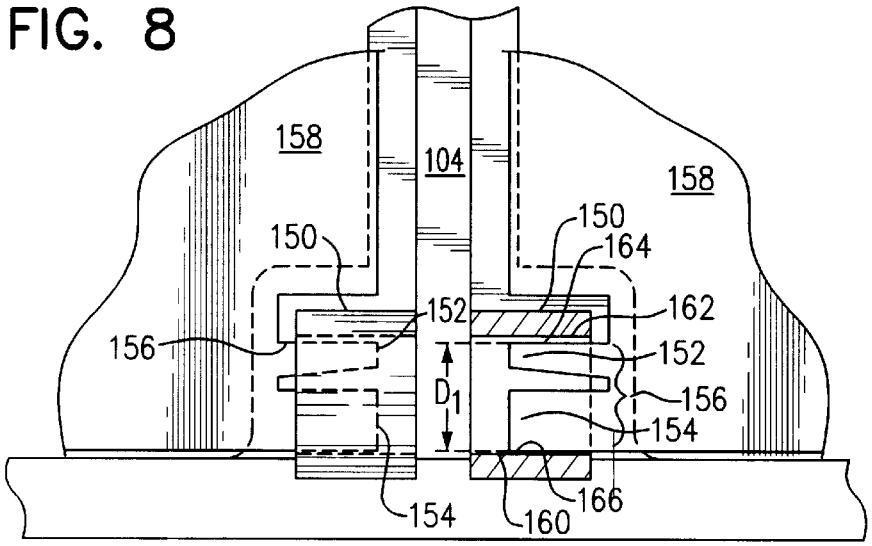
FIG. 8 is a partial vertical view showing a pair of doors with door hinge mechanism.
Figure 9:
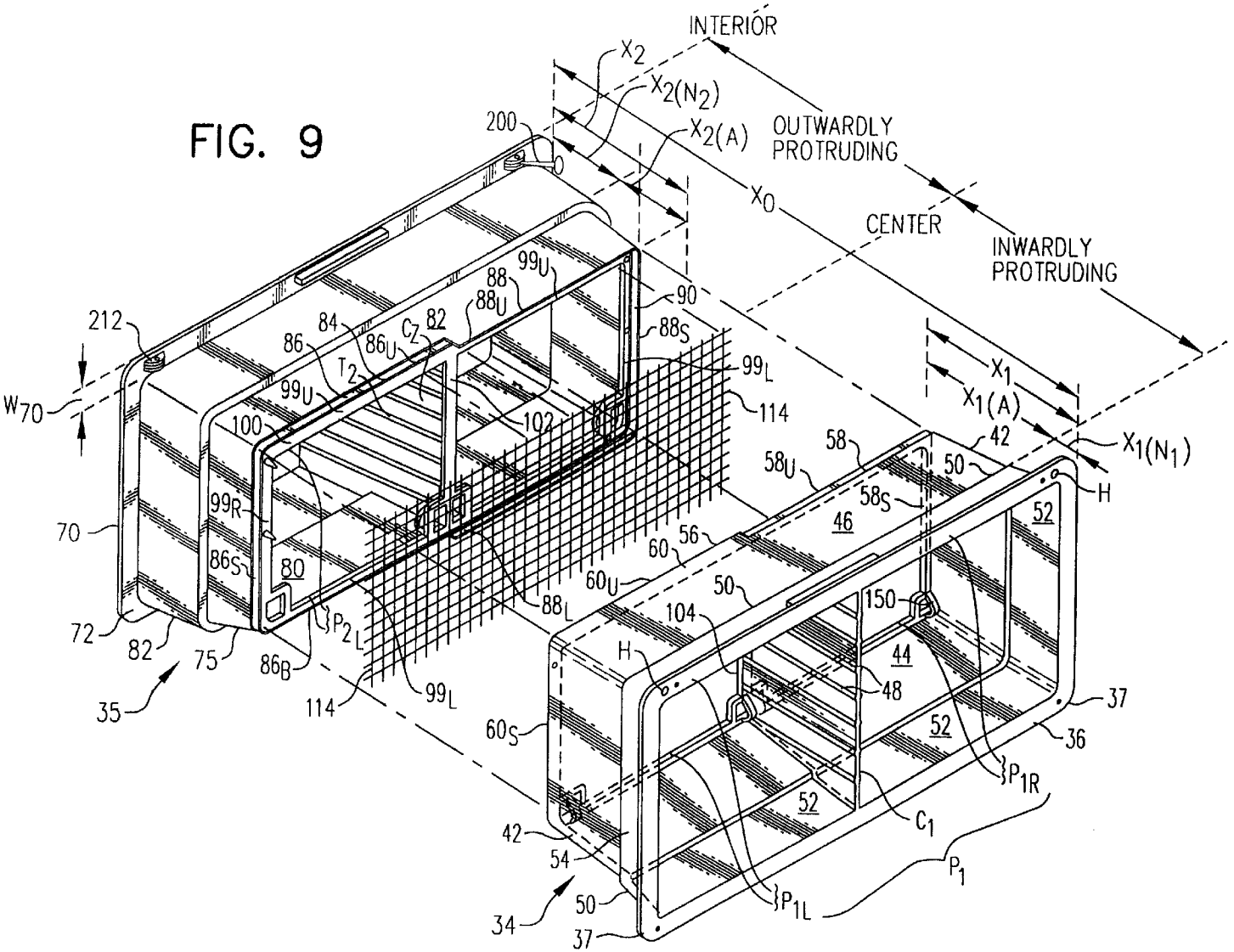
FIG. 9 is a perspective view, showing how a first frame member and a second frame member, each of preselected width, are jointed to build a final, assembled foundation ventilator of pre-selected width with a screen therebetween.

As more clearly set forth in FIGS. 4, 5, and 9, the foundation ventilator 30 has an overall thickness $X_0$ in the thru wall direction. This thickness $X_0$ of ventilator 30 is the sum of the overall thickness $X_1$ (in the thru-wall direction) of the first frame member 34 and the overall thickness $X_2$ (in the thru-wall direction) of the second frame member 35. Although any desired overall thickness $X_0$ should be possible utilizing the teachings herein, we prefer to provide an overall thickness $X_0$ which results when using (a) a first frame member with width XI of approximately 2, 4, or 6 inches, and (b) a second frame member with a width $X_2$ of approximately 2, 4, or 6 inches. In this fashion, we can easily build foundation ventilators of overall thickness $X_0$ of 6, 8, 10, or 12 inches.

The overall thru-wall thickness $X_1$ of first frame member 34 is made up of one or more, and preferably at least two of inwardly protruding thru-wall portions. For conceptual purposes, such protruding through-wall portions in the first frame member 34 are described, in sequence from the most interior to the most exterior portion, as $X_{1\text{-}A}, X_{1\text{-}B}, \ldots X_{1\text{-}N1}$, where $N_1$ corresponds (in order, alphabetically when using the nomenclature described herein) to the number of thru-wall portions provided in the selected frame member, and $N_1$ is any letter selected in a sequence from A through N, where the total number of letters utilized in the sequence represents the number of thru-wall portions provided. Also, for conceptual purposes, the subscript utilized (in $N_1$ or in $X_2$, for example) represents whether the first 34 or second 35 frame member is being referred to by the reference subscript, with the subscript "1" being a reference to the first frame member 34, and with the subscript "2" being a reference to the second frame member 35.

In first frame member 34, the first, most interior, up inwardly protruding thru-wall portion $X_{1\text{-}A}$ (also marked with reference numeral 42 in FIG. 9) has a preselected thru-wall thickness $X_{1(A)}$. The first inwardly protruding thru-wall portion $X_{1\text{-}A}$ has an inner surface portion 44 and an outer surface portion 46. The inner surface portion 44 defines a thru passageway portion $P_1$. The passageway $P_1$ is further divided into left hand portion $P_{1L}$ to form a first thru passageway, and right hand portion $P_{1R}$ to form a second thru passageway, by a strengthening wall $C_1$, preferably substantially vertical and centrally located. As necessary, strengthening ribs 48 are provided, in strengthening wall $C_1$, preferably aligned in the thru-wall direction.

Adjacent the exterior peripheral edge flange 36 of first frame member 34, the outermost inwardly protruding wall portion $X_{1\text{-}N1}$ is provided in thickness $X_1(N_1)$. The outermost inwardly protruding wall portion $X_{1\text{-}N1}$ is also marked with reference numeral 50 in FIG. 9. That outermost thru-wall portion $X_{1\text{-}N1}$ has an inner surface portion 52 and an outer surface portion 54.

Figure 3:
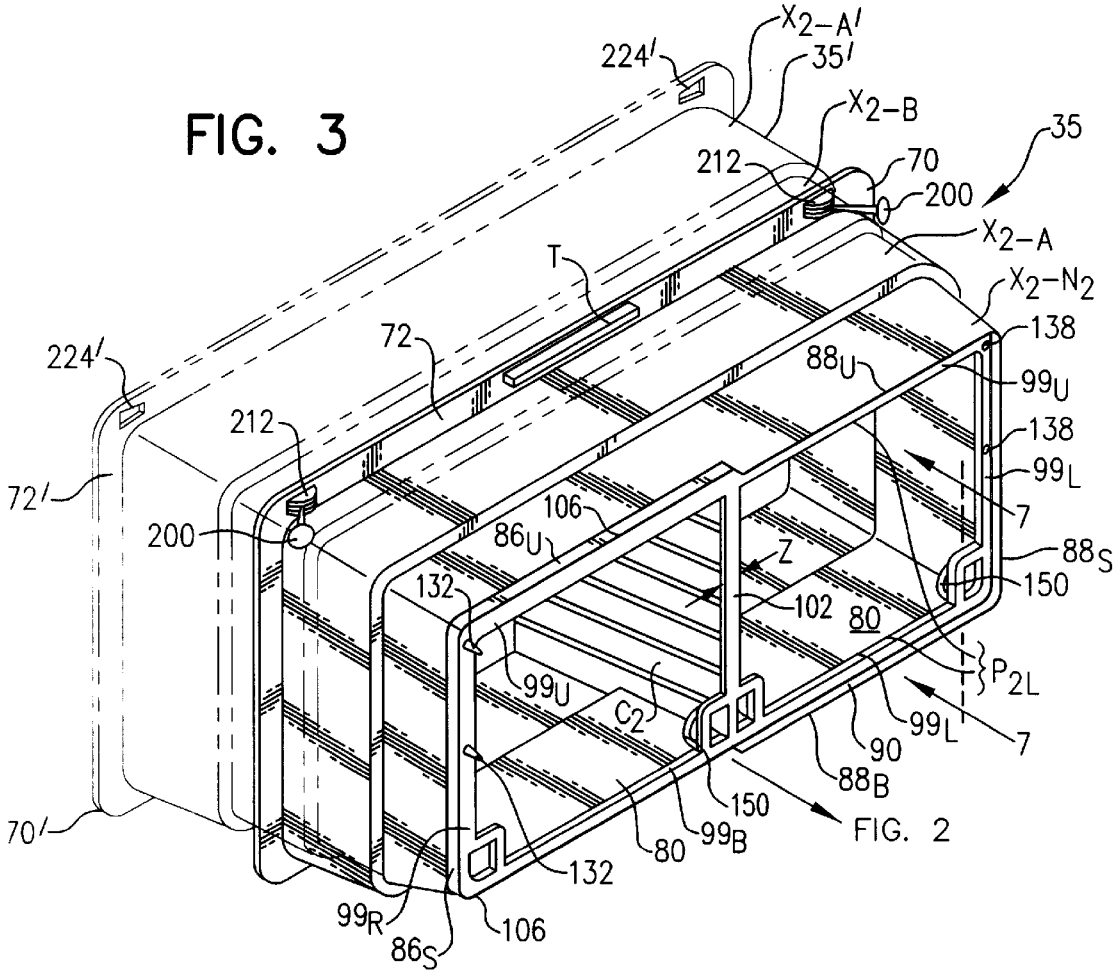
FIG. 3 is a perspective view of a second frame member of our multi-part foundation ventilator design, showing the details for joining of the second frame member to a first frame member such as that just illustrated in FIG. 2 above.

As best seen in FIG. 5, optionally, at least one intermediate inwardly protruding wall portion $X_{1\text{-}B}$ of thru-wall thickness $X_1(B)$ may be provided. In FIG. 3, a similar configuration is depicted for the second frame member, with reference numeral 35' indicating a second frame member having an intermediate thru-wall portion $X_{2\text{-}B}$.

As illustrated in FIGS. 4 and 9, the outer surface portion 46 of the first inwardly protruding thru-wall portion $X_{1\text{-}A}$, also marked with reference numeral 42, has a distal edge 56. Importantly, at least a portion of the distal edge portion 56 is configured into a first receiving ledge portion 58. The other part of the outer surface portion 46 has an outwardly protruding first joining flange portion 60.

As seen in FIGS. 3, 4, and 9, a second frame member 35 is provided for secure mating attachment and assembly with first frame member 34. The second frame member 35 has an interior wall peripheral flange 70 that is preferably integrally molded with the second frame member 35. The interior wall peripheral flange member 70 has an outwardly extending face width $W_{70}$ with thickness $T_{70}$ which is sufficient to effectively cover, with its rear surface 72, any gap or opening left between the multi-part foundation ventilator 30 and an interior surface of wall 32.

The second frame member 35 has an overall thru-wall thickness $X_2$. A series of N through-wall portions in the second frame member may be described, from the centermost portion to the interior portion, by the sequence $X_{2\text{-}A}$, $X_{2\text{-}B}, \ldots X_{2\text{-}N2}$, where $N_2$th letter is the number of thru-wall portions provided in the second frame member 35 (in order, alphabetically when using the nomenclature described herein). Each of the thru-wall portions $X_{2\text{-}A}$, $X_{2\text{-}B}, \ldots\ldots X_{2\text{-}N2}$, has a corresponding thru-wall thickness $X_{2(A)}$, $X_{2(B)}$, etc. through $X_{2(N2)}$. Therefore, the first outwardly protruding wall portion $X_{2\text{-}A}$, marked with reference numeral 75, has a preselected thru-wall thickness $X_{2(A)}$.

The first outwardly protruding wall portion 75 has an inner surface portion 80 defining a second thru passageway portion $P_2$; the second thru passageway area $P_2$ and the first thru passageway area $P_1$ are preferably of the same or similar complementary cross-sectional area. As in first frame member 35, the second thru passageway $P_2$ is preferably divided by a central strengthening wall $C_2$ into a left hand portion $P_{2L}$ to provide a third thru passageway, and right hand portion $P_{2R}$ to provide a fourth thru passageway.

The first outwardly protruding wall portion 75 further has an outer surface portion 82 having a distal edge 84. At least a portion of the outer surface portion 82 adjacent to the distal edge 84 is configured as a second receiving ledge portion 86. Also, at least a portion of the outer surface portion 82 also has an outwardly protruding joining flange portion 88 with in inward mating surface 90 adapted to snugly join and interfit with ledge 58.

Figure 6:
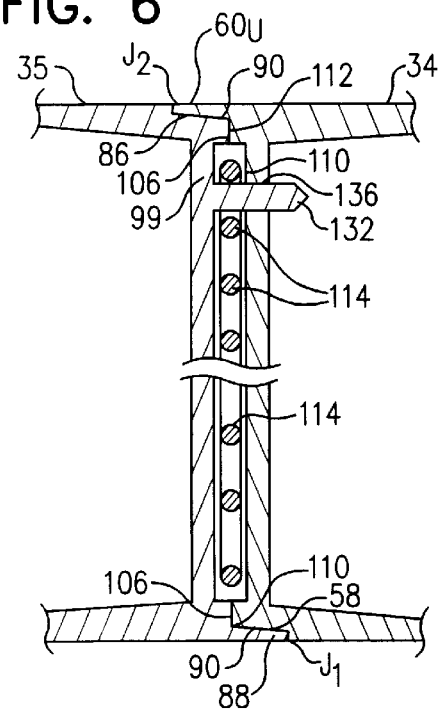
FIG. 6 is a vertical cross-sectional view showing how a porous screen member is provided between the first frame member and the second frame member.
Figure 7:
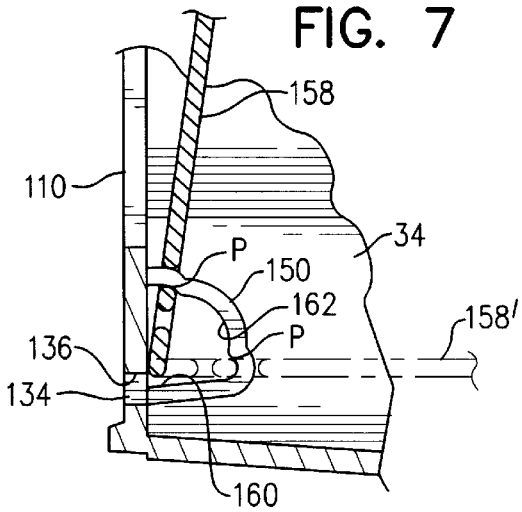
FIG. 7 is a partial vertical cross-sectional view showing the door hinge mechanism and door.
Figure 22:
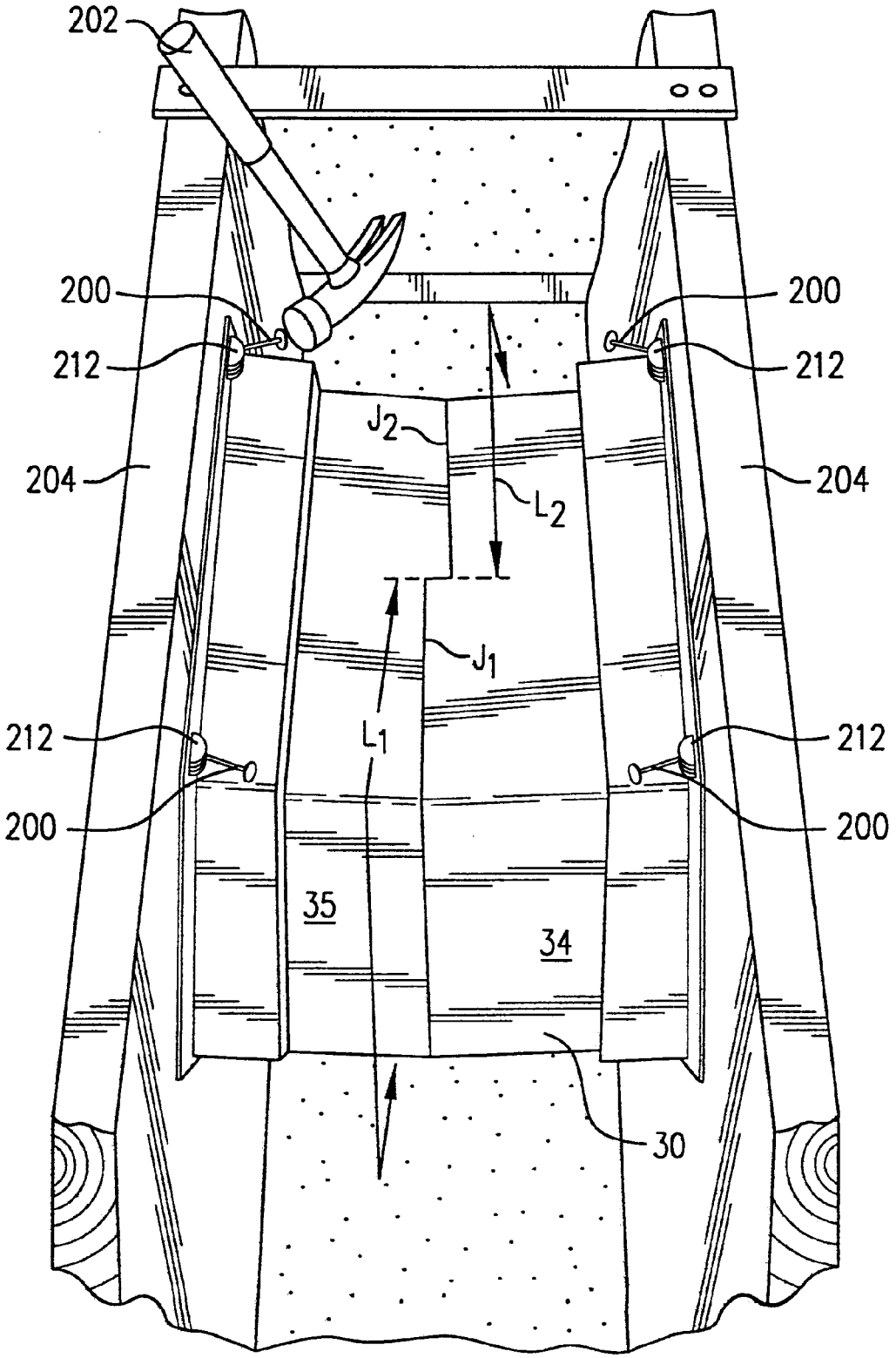
FIG. 22 is a perspective view of a foundation ventilator being installed between a pair of forms during preparation for pouring a concrete foundation wall, and particularly showing how the outwardly angled pre-affixed nails help quickly locate the ventilator and allow it to be attached while minimizing potential for a hammer to damage the ventilator.

The inwardly protruding joining flange portion 60 of the first frame member 34 is sized and shaped to fit in close fitting, overlying mating engagement with the second receiving ledge portion 86 of the second frame member 35. The outwardly protruding joining flange portion 88 of the second frame member 35 is sized and shaped to fit in close fitting, overlying mating engagement with the first receiving ledge 58 of the first frame member 34. Preferably, the first frame member 34 and the second frame member 35 are securely joined in sealed, leakless, mating engagement, so that liquids, such as from wet cement when wall 32 is being poured, are substantially prevented from migrating through the joint J formed between the first 34 and the second 35 frame members (see FIG. 6 or FIG. 22 below, for example) . To assure such leakless mating engagement, it is preferable that the inwardly protruding joining flange 60 and the second receiving ledge 84 are each provided in a complementary, matching joint $J_1$ of length $L_1$ around at least a portion of the perimeter of passageways $P_1$ and $P_2$. Also, in similar fashion, it is desirable that joint $J_2$ be provided by an outwardly protruding joining flange 88 and the first receiving ledge 58 in complementary, matching length $L_2$ around at least a portion of the perimeter of passageways $P_1$ and $P_2$. Ideally, inwardly protruding flange 60 is provided in a sideways opening, horizontally oriented U-shaped configuration with complementary receiving ledge 84, and the outwardly protruding flange 88 is provided in an opposing sideways opening, horizontally oriented U-shaped configuration with complementary receiving ledge 58. In such a fashion, flange 88 is made up of an upper part $\mathbf{88}_u$, a side part $\mathbf{88}_s$ and a lower part $\mathbf{88}_u$, which parts together form the U-shaped flange 88. Flange 60 is of similar construction with an upper part $\mathbf{60}_u$, a side part $\mathbf{60}_s$, and a lower part $\mathbf{60}_1$. In complementary fashion, the ledge 58 has an upper part $\mathbf{58}_u$, a side part $\mathbf{58}_s$, and a lower part $\mathbf{58}_l$. Likewise, ledge 86 of second frame member 58 has an upper part $\mathbf{86}_u$, a side part $\mathbf{86}_s$, and a lower part $\mathbf{86}_B$. The joint $J_1$ is thus of length $L_1$ corresponding to the length of flange 60, and joint $J_2$ is thus of length $L_2$ corresponding to the length of flange 88. The joint J, made up of joints $J_1$ and $J_2$, is sealed via use of an appropriate glue or sealing adhesive that is compatible with or as a solvent glue for the plastic or other material in which the ventilator 34 is manufactured. Ideally, the joint J results in the first frame member 34 being joined with the second frame member 35 in sealed, leakless engagement. However, the exact shape of the opposing mating flange and ledge portions as just described in this paragraph (flange 60 over ledge 86, and flange 88 over ledge 58) can be provided in any desired perimeter section, in the alternative, along an appreciable portion of each of the opposing distal end edges 56 and 84 of frame members 34 and 35, respectively. More explicitly, in the preferred embodiment, a flange 60 on the first frame member 34 can be provided in any desired length so long as a complementary ledge portion 86 is provided on the second frame member 35, and so long as the flange 88 in the second frame member 35 is provided along the remainder of the distal end edge 84 of second frame member, with complementary ledge 58 provided in first frame member 34.

As seen in FIG. 3, in second frame member 35 a narrow, thin, peripheral flange 99 is provided which projects, transversely, into the passageway $P_2$, normally to define its perimeter at minimum cross-section, preferably from around the entire interior surface 80 of second frame member 35. For most purposes, a flange 99 of about one-quarter inch (¼") in width is adequate. Also, a thin, vertical column flange 102 is provided along the inner reaches 103 of wall $C_2$. A matching vertical column flange 104 is provided along the inner reaches of wall $C_1$ in first frame member 34. Vertical column flanges 102, and 104 are usually provided in a width Z of about one-half inch (½"). Peripheral flange 99 is provided with a spacing lip 106 to allow spacing of flange 99 apart from a similar narrow thin peripheral flange 110 on first frame member 34, by means of contact between spacing lip 106 and spacing lip 112. In this manner, the thin raised ridge spacing lip 112 and the thin raised ridge spacing lip 106 each define a generally L-shaped peripheral caging surface to accommodate, between flange 99 and 110, and interior of spacing lips 106 and 112, a porous screen member 114.

The two-piece ventilator construction of the type just described provides some important improvements over earlier two-piece ventilators known to us. Primarily, the utilization of a flanged joint J provides a large surface area along the "flange to ledge" joints, as described, which allows a large contact area between the first 34 and second 35 frame members when they are glued together. That allows a strong joint J to be created, and such a joint can be easily and reliably sealed to substantially prevent, if not entirely eliminate, the passage of liquids therethrough. This is important as it prevents watery concrete mixtures from reaching the interior surfaces of the ventilator 30.

More specifically, to provide a strong joint J in the foundation ventilator as set forth in FIG. 9, the first frame member 34 has a first receiving ledge 58 and a first joining flange 60, each preferably provided, in the alternative, along an appreciable portion of the distal end 56 of the inwardly protruding wall portion 46. Correspondingly, the second frame member 35 has a second receiving ledge 86 and a second joining flange 88, in the alternative, complementary in location to the corresponding mating parts in the first frame member 34. We prefer to provide a first frame member 34 which has a left side (corresponding to the left side passageway $P_{1L}$) on which a portion $\mathbf{60}_s$ of the first joining flange member 60 is located, and in preferably a mirror image complementary fashion, a right side on which a portion $\mathbf{58}_s$ of the first receiving ledge 58 is located. In such cases, then the second frame member 35 has a right side (looking outwardly, as indicated in FIG. 9) on which a portion $\mathbf{86}_s$ of the second receiving edge 86 is located, and a left side on which a portion $\mathbf{88}_s$ of the second joining flange member 88 is located. Of course, the frame of reference just used to describe the ventilator first and second frame members is arbitrary, and the reverse scheme, where left and right locations are switched, are equally viable, as well as other schemes which utilize such mating members for joining the first and second frame members 34 and 35.

For simplicity, we prefer to provide ventilators 30 in which the first joining flange member 60 substantially forms the first one-half of a rectangle, and where the second receiving ledge member 86 forms a second one-half rectangle substantially conforming in size and shape complementary to the first one-half rectangle, so that the first joining flange member 60 and the second receiving ledge member 86 are brought together in close fitting complementary mating engagement. Likewise, it is preferred that the second joining flange member 88 substantially form a third one-half of a rectangle, and that the first receiving edge member 58 forms a fourth one-half rectangle substantially conforming in size and shape complementary to the third one-half rectangle, so that said second joining flange 88 and said first receiving ledge 58 are brought together in close fitting complementary mating engagement.

As is most evident in FIGS. 3 and 9 which illustrate the second frame member 35, an important and strengthening feature provided in our ventilator design is the use of the narrow, thin, peripheral flange 99, which also serves as a retaining flange, and which extends transversely, substantially perpendicular from the inner surface 80 of the outwardly protruding wall portion 75 into the second thru passageway $P_{2R}$, from at or near the distal end 84 of said the second inwardly projecting wall portion 80. The peripheral flange 99 has a right portion $99_R$, a left portion $99_L$, an upper portion $99_U$, and a lower portion, $99_B$. Similarly, in the first frame member 34, a thin, narrow, retaining flange 110 extends transversely and substantially perpendicular from the inner surface 44 of the first inwardly projecting wall portion 46 into the first thru passageway $P_1$, from at or near the distal end of the first inwardly projecting wall portion 46.

The interior peripheral flange 110 of the first frame member 34 ideally includes one or more first guide pin members 130 which are rigidly affixed or integrally molded with flange 110, and which extend therefrom substantially along the axis of the thru passageway $P_1$. Similarly, the interior peripheral flange 99 of the second frame member 35 includes one or more second guide pin members 132 which are rigidly affixed or integrally molded with flange 99, and which extend therefrom along the axis of the thru passageway $P_2$. In flange 110 are also located one or more first guide pin receiving apertures 134, each of which is defined by edge portions 136, for accommodating and locating second guide pin members 132. In complementary fashion, in flange 99, there are located one or more second guide pin receiving apertures 138, each of which is defined by edge portions 140. The combination of strong guide pins and tight receiving apertures also help to create a strong joint between the first 34 and second 35 frames, since the receiving apertures are adapted to receive therein in snug fitting mating engagement the guide pin members 130 and 132.

We prefer to provide the interior peripheral flange 99 in the second frame member 34, and the interior flange 110 in the first frame member 35, with a pair of laterally spaced apart, complementary door pivot receiving cage members 150. The door pivot receiving cage members 150 are preferably provided at the lower lateral margins of passageways $P_{1R}$, $P_{1L}$, $P_{2R}$, and $P_{2L}$, and extending at least a short distance laterally into the same. The door pivot receiving cage member 150 are preferably provided each in about one-quarter inch width, or slightly smaller in width than the lateral extension width $W_{156}$ of the frictional ears 152 and 154 of latch tabs 156 of doors 158. Also, cage member 150 is preferably provided in a somewhat horizontal or inverted shape V-shaped ledge fashion, with a working diameter between the inner bottom 160 and the inner top 162 complementary to the working diameter $D_1$ of upper 152 and lower 154 frictional ears of latch tab 156 at the lateral edges of doors 158. In this manner, frictional ear 152 has an upper edge 164 that rubs against inner top 162 to provide frictional positioning of the doors 158, while the lower edge 166 of lower ear 154 rubs against inner bottom 160 of the cage member 150.

Preferably, the tabs 156 in doors 158, or alternately the entire door 158, are provided in a relatively soft plastic, compared to the material used for forming the cage member 150, so that the doors 158 are flexibly but reliably positionable at one or more pinch points P in the inner bottom 160 of cage member 150. Generally, we prefer to make the first and second frame members of ABS plastic, and the door 158 of high density polyethylene plastic.

To further assist in opening and closing of door 158, the door is provided with a pinchable grasping ridge 170, either raised and protruding as is shown in FIG. 4, or recessed, with dimples 172, as is illustrated in FIG. 5. As illustrated, door 158 may be opened, as shown in FIG. 5 in the horizontal position, or closed, by moving the door 158 in the upward direction indicated by reference arrow 174 in FIG. 5, where the door finally effectively closes passageways $P_{1L}$, and $P_{1R}$, in first frame section 34. Alternately, and uniquely in our design, doors 158 can also be provided for passageways $P_{2R}$ and $P_{2L}$ in second frame member 35.

In colder climates, it is sometimes advantageous to further provide insulating plugs 180, for completely and effectively shutting down the air flow thru vent 30, as is illustrated in FIGS. 10 thru 18. We prefer to use a unique reversible plug 180 which has a serrated inner edge 182 with indentations 184 corresponding to ribs 48 in center column $C_1$, wherein the edge 182 is sized for complementary meshing engagement with the ribs 48. Likewise, an inwardly sloping outer edge 186 of plug 180 is provided for complementary snug fitting engagement with inner surface 52 of first frame 34. It is important to note that at the lower reaches of first frame member 34, the surface 52 has an upward gradient, so the inward sloping outer edge 186 would be upwardly sloping, so that the interior wall surface 52 would allow any fluid impinging thereon to drain outward. Also, it should be noted that the first G or any subsequent inward ledge portions further define a barrier against inward migration of a fluid.

For handling reversible plugs 180, note that grips 190 can be provided in recessed fashion between dimples 192. Thickness of plugs 180 in the air passageway direction can be as necessary or desired for the particular climate, but we prefer a thickness of about one inch, more or less.

Figure 19:
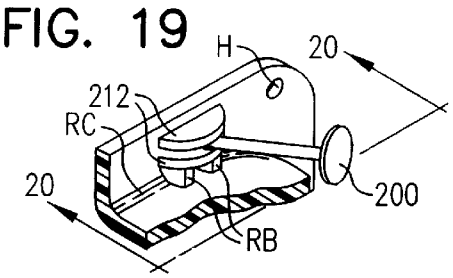
FIG. 19 is a detail showing the molded nail holder and nail assembled for shipment of our foundation ventilator.
Figure 19A:
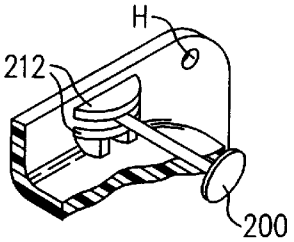
FIG. 19A is a detail showing another configuration for a nail and nail holder, assembled for shipment.
Figure 20:
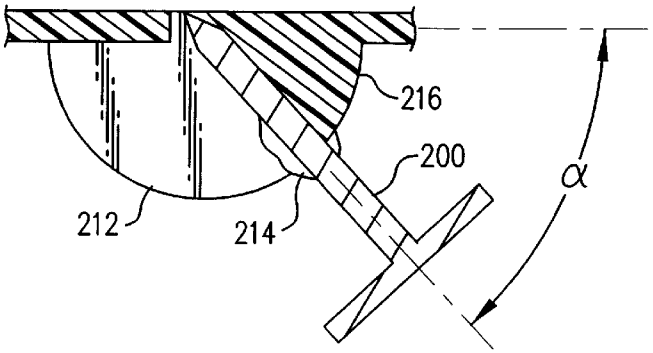
FIG. 20 is a cross-sectional view of the molded nail holder and nail, showing the nail support provided.
Figure 10:
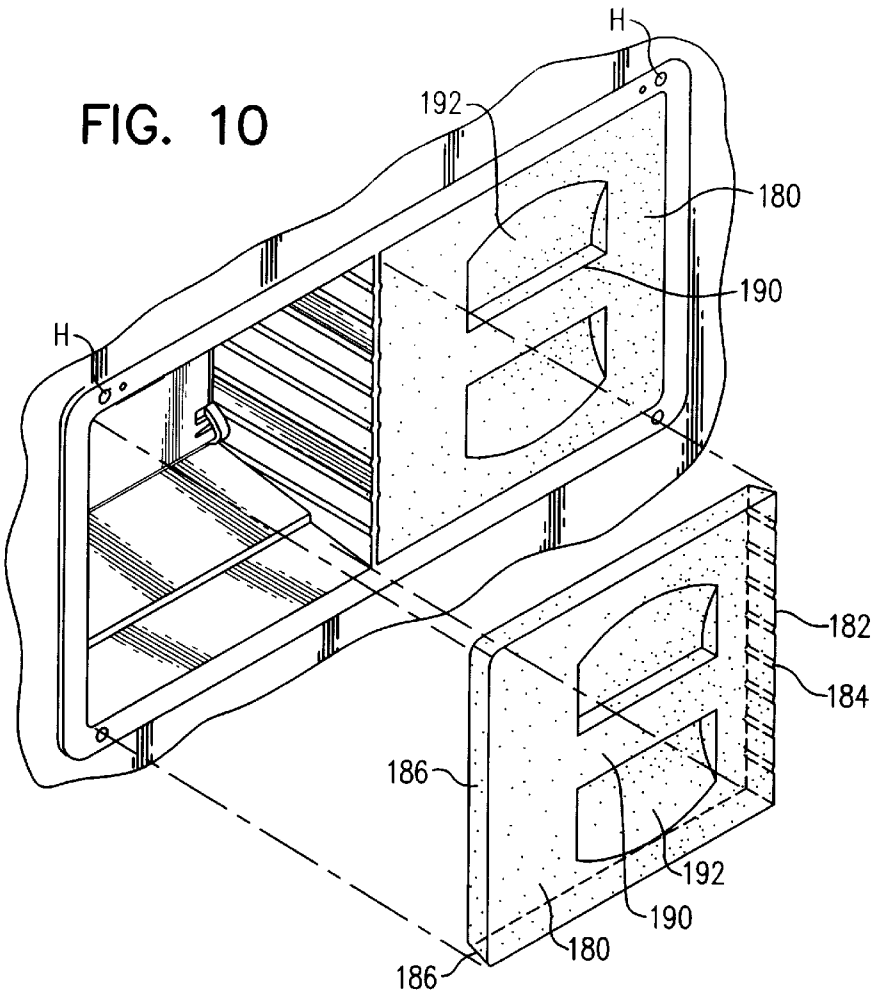
FIG. 10 illustrates the use of a removable insulating plug in the foundation ventilators.
Figure 11:
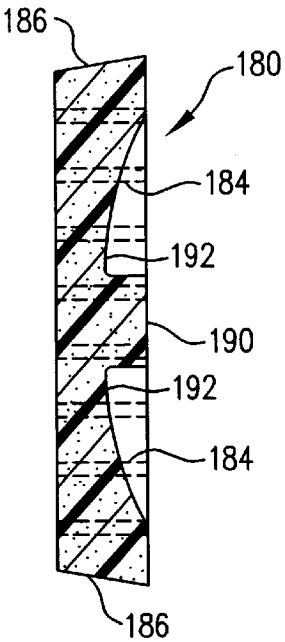
FIG. 11 is a vertical cross-sectional view of a removable insulating plug, showing the centrally located handle grip provided.
Figure 23:
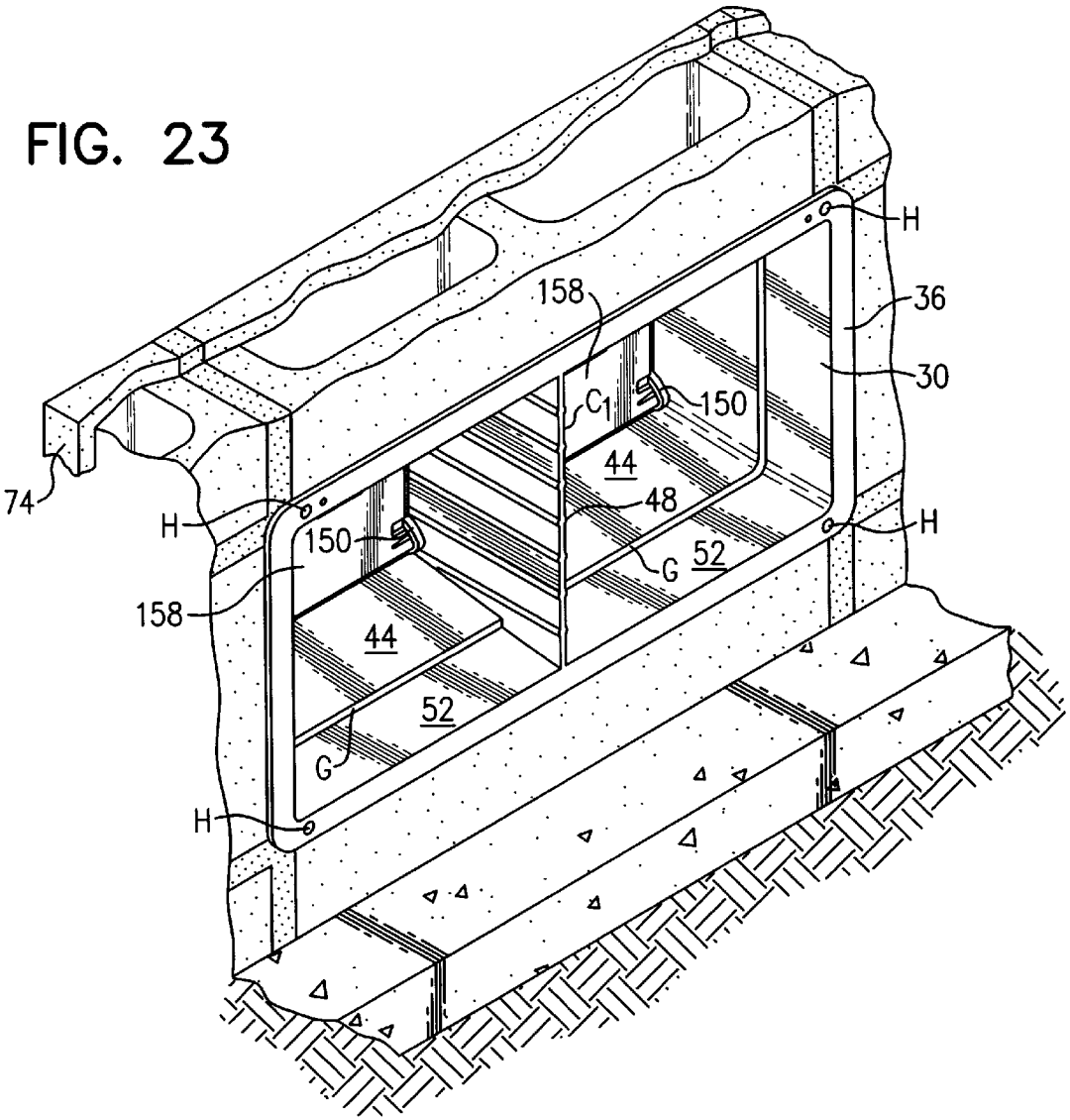
FIG. 23 is a perspective view of a our novel foundation ventilator being installed in a block type foundation wall.
Figure 12:
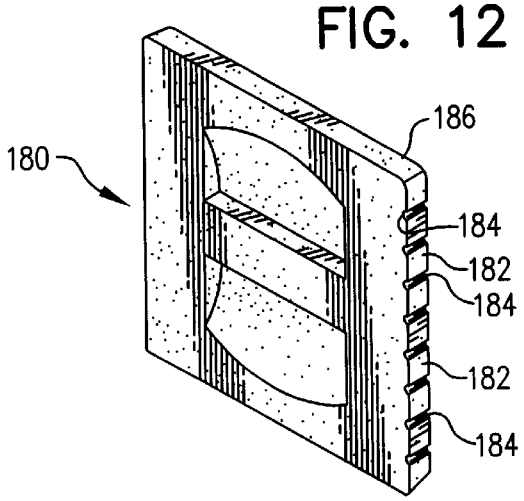
FIG. 12 is a perspective view of a left hand removable insulating plug.
Figure 13:
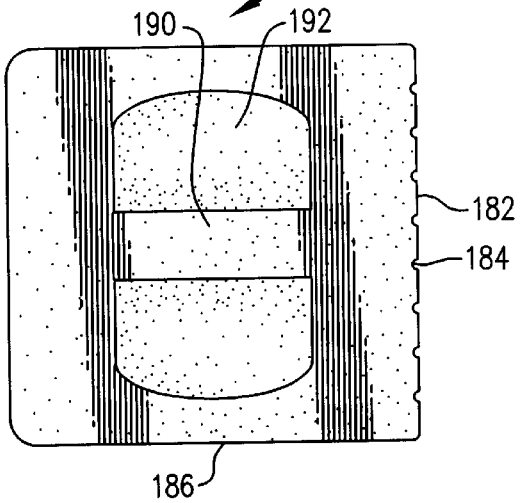
FIG. 13 is a front elevation view of a left hand removable insulating plug.
Figure 14:
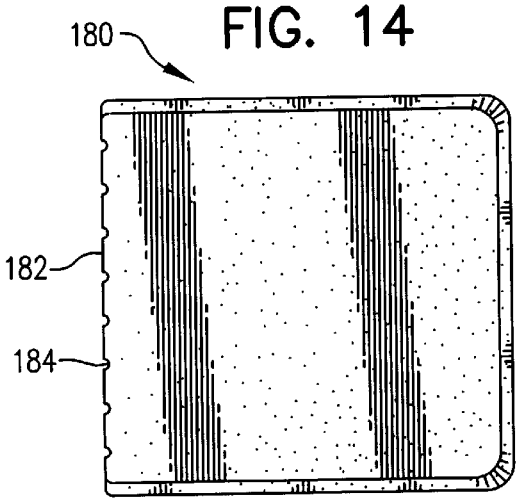
FIG. 14 is a rear elevation view of a left hand removable insulating plug.
Figure 15:
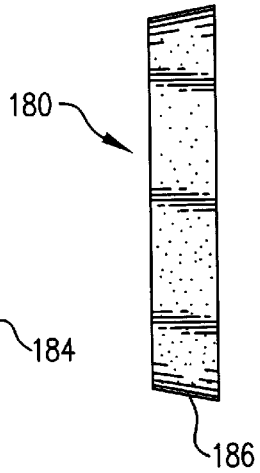
FIG. 15 is a left side view of a left hand removable insulating plug.
Figure 16:
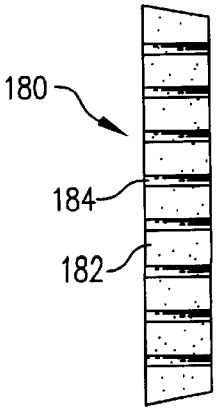
FIG. 16 is a right side view of a left hand removable insulating plug.
Figure 17:
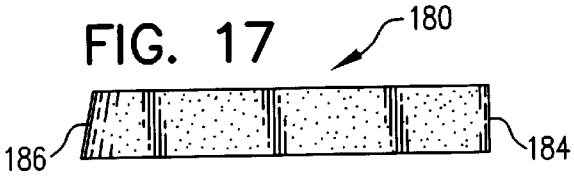
FIG. 17 is a top view of a left hand removable insulating plug.
Figure 18:
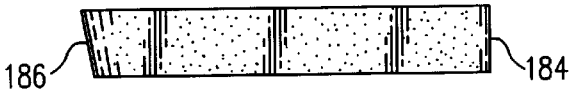
FIG. 18 is a bottom view of a left hand removable insulating plug.
Figure 20A:
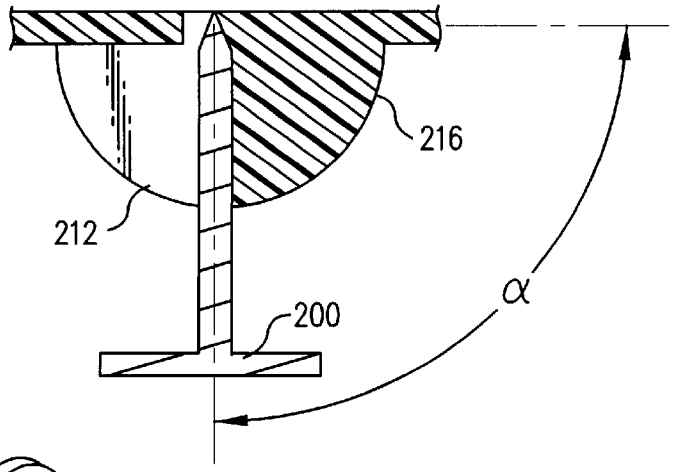
FIG. 20A is a cross-sectional view of a second configuration of a molded nail holder and nail.

Turning now to FIGS. 19 and 20, it can be seen that we prefer to provide a set of pre-glued nails 200 with ventilator 30. In this manner the ventilator 30 is ready for nailing via hammer 202 to a selected substrate, normally a wooden form 204, as is further depicted in FIG. 22. As shown in FIG. 19, in one preferred embodiment, at least on nail socket 210 is provided, which structurally includes a pair of opposing, preferably substantially semicircular, spaced apart upper and lower lips 212. The upper and lower lips 212 are spaced and adapted to frictionally secure therebetween a nail 200 of preselected size. Ideally, an easily releasable adhesive 214 is used to secure the nail 200 in place, and an angle alpha ($\alpha$) as provided by angular wedge 216 between lips 212. To provide the necessary strength to assure that lips 212 do not break off when nail 200 is pounded into the adjacent form, one or more, and preferably two strengthening ribs RB are provided between lower surface $212_L$ of the lower of lips 212 and the upper surface 54 of first portion $X_1$-$N_1$ of first frame member $X_1$. Substantially identical strengthening ribs RB are provided in corresponding parts in second frame member $X_2$. See FIG. 4 and FIG. 19 to view details. As shown in FIGS. 19A and 20A, nails 200 may be provided with a simple friction fit, and oriented perpendicular to flange 34 or 35 by wedge 216'.

Figure 24:
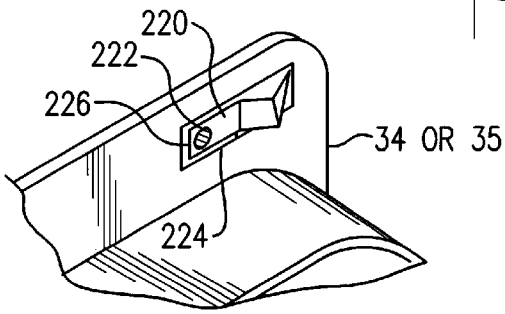
FIG. 24 shows a partial perspective view of a nailing clip which is an alternate to using a nail for attachment of the ventilator between form panels prior to pouring concrete.
Figure 25:
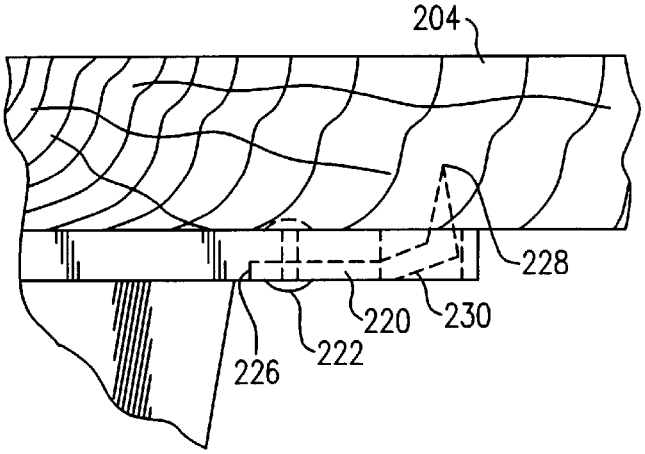
FIG. 25 shows a partial top view of a foundation ventilator which is using a nailing clip to join the ventilator to a form panel prior to pouring concrete to form a wall.
Figure 26:
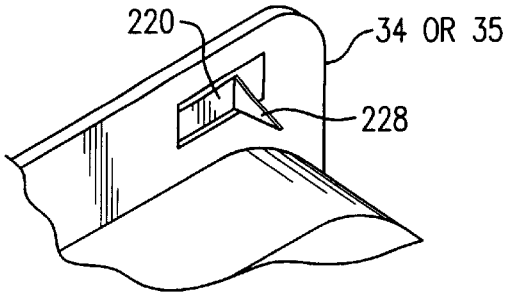
FIG. 26 is a partial perspective view of the outside of a foundation ventilator, depicting the configuration of a nailing clip before positioning of a ventilator between form panels.

Alternately, an angular nailing tab 220 may be provided, as illustrated in FIGS. 24–26. Tab 220 is affixed to first frame 34 and second frame 35 of ventilator 30 via rivet 222 or other suitable fastener. Ideally, a recessed preferably rectangular slot 224 is provided to accommodate a preferably generally rectangular shaped nailing tab 220. The nailing tab, while being affixed at a first end 226 by the rivet 222, is flexible at the second end which preferably terminates at a generally triangularly shaped chisel point 228, and which is crimped and shaped so as to be adapted to be driven along a rear surface 230 thru aperture defined by edge 232 thru a peripheral flange of frame 34 or 35, and into wooden form 204.

It is to be appreciated that the novel foundation ventilator provided by the present invention is a significant improvement in the state of the art of foundation ventilators, especially for providing foundation ventilators of various widths without taking up excess inventory space. It is thus clear from the heretofore provided description that our novel multi-part foundation ventilators, is an appreciable improvement in the state of the art of of building foundation ventilators. Although only a few exemplary embodiments of this invention have been described in detail, it will be readily apparent to those skilled in the art that the our novel ventilator device may be modified from those embodiments provided without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, the claims are intended to cover the structures described herein, and not only structural equivalents thereof, but also equivalent structures. Thus, the scope of the invention, as indicated by the appended claims rather than by the foregoing description, is intended to include variations from the embodiments provided which are nevertheless described by the broad meaning and range properly afforded to the language of the claims, or to the equivalents thereof.

We claim:

1. A foundation ventilator, said ventilator comprising:

(a) a first frame member, said first frame member comprising:

(i) a first exterior peripheral edge flange, and (ii) extending from said first exterior peripheral edge flange, a first inwardly protruding wall portion of preselected length $X_{1(A)}$, said first inwardly protruding wall portion having an inner surface portion defining a first thru passageway portion, said first inwardly protruding wall portion further comprising an outer surface portion having a distal edge, (A) wherein at least a portion of said outer surface portion adjacent to said distal edge further comprises a first receiving ledge portion, and (B) wherein at least a portion of said first inwardly protruding wall portion further comprises, adjacent to said distal edge of said outer surface portion, a protruding, first joining flange portion;

(b) a second frame member, said second frame member comprising:

(i) a second exterior peripheral edge flange, and (ii) extending from said second exterior peripheral edge flange, a second inwardly protruding wall portion of preselected length $X_{2(A)}$, said second inwardly protruding wall portion having an inner surface portion defining a second thru passageway portion, said second inwardly protruding wall portion further comprising an outer surface portion having a distal edge, (A) wherein at least a portion of said outer surface portion adjacent to said distal edge further comprises a second receiving ledge portion, and (B) wherein at least a portion of said second inwardly protruding wall portion further comprises, adjacent to said distal edge of said outer surface portion, a protruding, second joining flange portion;

(c) wherein said first joining flange portion of said first frame member is sized and shaped to fit in close fitting, overlying engagement with said second receiving ledge portion of said second frame member, and (d) wherein said second joining flange portion of said second frame member is sized and shaped to fit in close fitting, overlying engagement with said first receiving ledge of said first frame member, (e) said first frame member and said second frame member securely joined in mating engagement at a joint therebetween.

2. The ventilator as set forth in claim 1, wherein said first frame member and said second frame member are joined in sealed, leakless, mating engagement, so that liquids are substantially prevented from migrating through said joint between said first and said second frame members.

3. The ventilator as set forth in claim 1, wherein said first joining flange and said second receiving ledge are each provided in complementary, matching lengths.

4. The ventilator as set forth in claim 3, wherein said second joining flange and said first receiving ledge are each provided in complementary, matching lengths.

5. The ventilator as set forth in claim 4, wherein said first joining flange and said first receiving ledge of said first frame member are each provided, in the alternative, along an appreciable portion of said distal end of said inwardly protruding wall portion of said first frame member.

6. The ventilator as set forth in claim 5, wherein said second joining flange and said second receiving ledge of said second frame member are each provided, in the alternative, along an appreciable portion of said distal end of said inwardly protruding wall portion of said second frame member.

7. The ventilator as set forth in claim 6, wherein said first frame member has a left side on which said first joining flange member is located.

8. The ventilator as set forth in claim 7, wherein said first frame member has a right side on which said first receiving ledge is located.

9. The ventilator as set forth in claim 6, wherein said second frame member has a left side on which said second joining flange member is located.

10. The ventilator as set forth in claim 9, wherein said second frame member has a right side on which said second receiving ledge is located.

11. The ventilator as set froth in claim 10, wherein said first joining flange member substantially forms first one-half of a rectangle, and where said second receiving edge member forms a second one-half rectangle substantially conforming to said first one-half rectangle, so that said first joining flange and said second receiving ledge may be brought together in close fitting complementary mating engagement.

12. The ventilator as set froth in claim 11, wherein said second joining flange member substantially forms third one-half of a rectangle, and where said first receiving edge member forms a fourth one-half rectangle substantially conforming to said third one-half rectangle, so that said second joining flange and said first receiving ledge may be brought together in close fitting complementary mating engagement.

13. The ventilator as set forth in claim 12, wherein said first frame member further comprises a first interior peripheral flange, said first interior peripheral flange extending substantially perpendicular from said inner surface of said first inwardly projecting wall portion into said first thru passageway, from at or near the distal end of said first inwardly projecting wall portion.

14. The ventilator as set forth in claim 13, wherein said second frame member further comprises a second interior peripheral flange, said second interior peripheral flange extending substantially perpendicular from said inner surface of said second inwardly projecting wall portion into said second thru passageway, from at or near the distal end of said second inwardly projecting wall portion.

15. The ventilator as set forth in claim 13, wherein said first interior peripheral flange further comprises a first pair of laterally spaced apart, complementary door pivot receiving cage members.

16. The ventilator as set forth in claim 14, wherein said second interior peripheral flange further comprises a second pair of laterally spaced apart, complementary door pivot receiving cage members.

17. The ventilator as set forth in claim 16, wherein said first frame member further comprises a first structural reinforcing divider, said first structural reinforcing divider defining in said first frame member (a) a first end of said first thru passageway, and (b) in cooperation with at least a portion of said interior wall surface of said first inwardly projecting wall portion, a third thru passageway.

18. The ventilator as set forth in claim 17, wherein said second frame member further comprises a second structural reinforcing divider, said second structural reinforcing divider defining in said second frame member (a) a first end of said second thru passageway, and, (b) in cooperation with at least a portion of said interior wall surface of said second inwardly projecting wall portion, a fourth thru passageway.

19. The ventilator as set forth in claim 17, wherein said first interior peripheral flange further comprises a third pair of laterally spaced apart, complementary door pivot receiving cage members.

20. The ventilator as set forth in claim 14, wherein said second interior peripheral flange further comprises a fourth pair of laterally spaced apart, complementary door pivot receiving cage members.

21. The ventilator as set forth in claim 13, wherein said interior peripheral flange of said first frame member further comprises:

(a) one or more first guide pin members, said one or more first guide pin members rigidly affixed to said lip and extending therefrom substantially along the axis of said thru passageway, and (b) one or more first guide pin receiving apertures, said one or more first guide pin receiving apertures defined by edge portions.

22. The ventilator as set forth in claim 14, wherein said second interior peripheral flange of said second frame member further comprises:

(a) one or more second guide pin members, said one or more second guide pin members rigidly affixed to said lip and extending therefrom substantially along the axis of said thru passageway, and (b) one or more second guide pin receiving apertures, said one or more second guide pin receiving apertures defined by edge portions and adapted to receive therein in snug fitting mating engagement said first guide pin members.

23. The ventilator as set forth in claim 1, wherein said distal end of said inwardly projecting wall of said first frame portion further comprises a first thin raised ridge portion, said thin raised ridge portion located at the outer periphery of said inwardly projecting lip so as to define a generally L-shaped peripheral caging surface.

24. The ventilator as set forth in claim 23, wherein said distal end of said inwardly projecting wall of said second frame portion further comprises a second thin raised ridge portion, said thin raised ridge portion located at the outer periphery of said inwardly projecting lip, so as to define a generally L-shaped peripheral caging surface.

25. The ventilator as set forth in claim 24, further comprising a porous screen member, said porous screen member affixed (a) interior of said first and said second thin raised ridge portions, and (b) between said first interior lip of said first frame member, and said second interior lip of said second frame.

26. The ventilator as set forth in claim 1, further comprising a first door for said first thru passageway, said first door further comprising a first door hinge, said first door hinge adapted to interface with said first pair of said laterally spaced apart, complementary door pivot receiving cage members, so that said first door hinge is frictionally positionable at a desired position.

27. The ventilator as set forth in claim 26, further comprising a second door for said second thru passageway, said second door further comprising a second door hinge, said second door hinge adapted to interface with said first pair of said laterally spaced apart, complementary door pivot receiving cage members, so that said second door hinge is frictionally positionable at a desired position.

28. The ventilator as set forth in claim 27, wherein said complementary door pivot receiving cage members each comprises a generally inverted V-shaped ledges, said generally inverted V-shaped ledges extending at least a short distance transversely inwardly into said thru passageway.

29. The ventilator as set forth in claim 28, wherein said first frame member and said second frame member are each comprised of a relatively hard plastic, and wherein said door is comprised of a relatively soft plastic, and where said first door hinge is flexibly but reliably positionable along said complementary door pivot receiving cage members.

30. The ventilator as set forth in claim 29, wherein said first and said second frame members are comprised of ABS plastic.

31. The ventilator as set forth in claim 29, wherein said door is comprised of polyethylene plastic.

32. The ventilator as set forth in claim 1, wherein said first inwardly projecting wall portion of said first frame member further comprises:

(a) a third inwardly projecting wall portion, and (b) a first inward ledge portion, (c) and wherein said third inwardly projecting wall portion is of preselected length $X_1(B)$ and extends from said first exterior peripheral edge flange to said first inward ledge portion, and wherein said first inwardly projecting wall portion continues inwardly from said first inward ledge portion.

33. The ventilator as set forth in claim 1, wherein said second inwardly projecting wall portion of said second frame member further comprises (a) a fourth inwardly projecting wall portion, and (b) a second inward ledge portion, (c) and wherein said fourth inwardly projecting wall portion is of preselected length $X_2(B)$ and extends from said second exterior peripheral edge flange to said second inward ledge portion, and wherein said second inwardly projecting wall portion continues inwardly from said second inward ledge portion.

34. The ventilator as set forth in claim 32, wherein said first inwardly projecting wall portion has a upward gradient, whereby said interior wall surface allows a fluid impinging thereon to drain outward.

35. The ventilator as set forth in claim 34, wherein said first inward ledge portion further defines a barrier against inward migration of a fluid impinging on said third inwardly projecting wall portion.

36. The ventilator as set forth in claim 1, wherein said first exterior peripheral edge flange further comprises at least one nail socket, said at least one nail socket adapted to secure a nail therein, so that a nail may be placed in said at least one nail socket at time of manufacture, ready for nailing to a selected substrate in the field.

37. The ventilator as set forth in claim 36, wherein said at least one nail socket comprises a pair of opposing, substantially semicircular, spaced apart lips, said lips spaced and adapted to frictionally secure therebetween a nail of preselected size.

38. The ventilator as set forth in claim 37, further comprising a nail, said nail provided in said at least one nail socket.

39. The ventilator as set forth in claim 26, or in claim 27, wherein said door further comprises a gripping bar, said gripping bar comprising a laterally extending and vertically approachable manually grippable pinch point, said manually grippable pinch point adapted to allow said door to be opened and closed.

40. The ventilator as set forth in claim 1, wherein said first frame member further comprises a first flanged handle portion, said first flanged handle portion extending inwardly from the upper portion of said said peripheral flange, said first flanged handle portion adapted to allow said ventilator to be manually grasped and lifted.

41. The ventilator as set forth in claim 1, wherein said second frame member further comprises a second flanged handle portion, said second flanged handle portion extending inwardly from the upper portion of said said peripheral flange, said second flanged handle portion adapted to allow said ventilator to be manually grasped and lifted.

42. The ventilator as set forth in claim 1, further comprising a first insulating plug, said first insulating plug comprising a tight fitting insert adapted to fit into said first thru passageway.

43. The ventilator as set forth in claim 1, further comprising a second insulating plug, said second insulating plug comprising a tight fitting insert adapted to fit into said second thru passageway.

44. The ventilator as set forth in claim 43, wherein said first frame member of said ventilator is fabricated using a first frame member with a width $X_1$ overall selected from the group consisting of, approximately: 2, 4, or 6 inches.

45. The ventilator as set forth in claim 44, wherein said second frame member of said ventilator is fabricated using a second frame member with a width $X_2$ overall selected from the group consisting of, approximately: 2, 4, or 6 inches.

46. The ventilator as set forth in claim 45, wherein the width of the ventilator, in the thru passageway direction, is approximately six (6) inches.

47. The ventilator as set forth in claim 45, wherein the width of the ventilator, in the thru passageway direction, is approximately eight (8) inches.

48. The ventilator as set forth in claim 45, wherein the width of the ventilator, in the thru passageway direction, is approximately ten (10) inches.

49. The ventilator as set forth in claim 45, wherein the width of the ventilator, in the thru passageway direction, is approximately twelve (12) inches.

50. The ventilator as set forth in claim 26 or claim 27 above, wherein said hinge has an interior hinge pivot engaging portion, said hinge pivot engaging portion further comprising a plurality of hinge catch portions, said hinge catch portions adapted to engage said hinge pivot to allow said door to be securely positioned at an angle of opening defined by any one of said hinge catch portions.

51. The ventilator as set forth in claim 26 or 27, wherein said door is adapted to be removably attached to said ventilator.

52. The ventilator as set forth in claim 50 above, wherein said hinge pivot engaging portion of said door further comprises a first, laterally extending pivot prong, and spaced vertically thereabove, a second, laterally extending catch prong, and wherein said catch prong is adapted to be releasably secured in said hinge catch portions of said hinge pivot engaging portion.

53. The apparatus as set forth in claim 52, wherein each of said hinge catch portions further comprises a multiple keyed catch portion, said multiple keyed ketch portion defined by multiple keyed flange edges to locate multiple catch positions, so that any one of the multiple catch positions locates therein said catch portion of said door.

54. The apparatus as set forth in claim 1, wherein said first exterior peripheral edge flange and said first inwardly protruding wall portion are joined at a radiused interior corner joint.

55. The apparatus as set forth in claim 1, wherein said second exterior peripheral edge flange and said second inwardly protruding wall portion are joined at a radiused interior corner joint.

56. The apparatus as set forth in claim 37, further comprising one or more reinforcing ribs, and wherein said spaced apart ribs comprise a lower lip having a lower surface, wherein said one or more reinforcing ribs (a) extend below said lower surface of said lower lip to said first inwardly protruding wall portion, and (b) extend from said first exterior peripheral edge flange inward along the lower surface of said lower lip.

57. The apparatus as set forth in claim 37, further comprising one or more reinforcing ribs, and wherein said spaced apart ribs comprise a lower lip having a lower surface, wherein said one or more reinforcing ribs (a) extend below said lower surface of said lower lip to said first inwardly protruding wall portion, and (b) extend from said first exterior peripheral edge flange inward along the lower surface of said lower lip.

* * * * *

UNITED STATES PATENT AND TRADEMARK OFFICE

CERTIFICATE OF CORRECTION

PATENT NO. : 6,165,066
APPLICATION NO. : 09/273116
DATED : December 26, 2000
INVENTOR(S) : Thomas G. Sharp et al.

It is certified that error appears in the above-identified patent and that said Letters Patent is hereby corrected as shown below:

Title page, item [56]
IN REFERENCES CITED:

Under "U.S. Patent Documents", after the reference "2,843,035 7/1958 Jacks."
Add --3,220,079 11/1965 Aggson--

Under "Foreign Patent Documents", after the reference "278221", delete "10/1955" and substitute therefore --10/1951--.

Column 2, line 11, after the word "joint", delete "ther-ebetween" and substitute therefore --there-between--.
Column 5, line 38, after the word "width", delete "XI" and substitute therefore --$X_1$--.
Column 7, line 12, after the words "below, for", delete "example) ." and substitute therefore --example).--.
Column 10, line 34, after the words "at least", delete "on" and substitute therefore --one--.

Column 12, line 46, after the words "as set", delete "froth" and substitute therefore --forth--.
Column 16, line 27, after the word "keyed", delete "ketch" and substitute therefore --catch--.

Signed and Sealed this

Ninth Day of February, 2010

David J. Kappos

David J. Kappos
*Director of the United States Patent and Trademark Office*